US012442376B2

(12) United States Patent
Newport et al.

(10) Patent No.: US 12,442,376 B2
(45) Date of Patent: Oct. 14, 2025

(54) RADIAL INFLOW HOLE GEOMETRY

(71) Applicant: Halliburton Energy Services, Inc., Houston, TX (US)

(72) Inventors: Casey Laine Newport, Tulsa, OK (US); David McManus, Tulsa, OK (US); Andre Joseph Bernier, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 191 days.

(21) Appl. No.: 18/209,013

(22) Filed: Jun. 13, 2023

(65) Prior Publication Data

US 2024/0360744 A1 Oct. 31, 2024

Related U.S. Application Data

(60) Provisional application No. 63/462,806, filed on Apr. 28, 2023.

(51) Int. Cl.
*F04D 13/08* (2006.01)
*E21B 43/08* (2006.01)

(52) U.S. Cl.
CPC ..... *F04D 13/086* (2013.01); *E21B 43/08* (2013.01)

(58) Field of Classification Search
CPC ..... F04D 13/086; F04D 13/10; E21B 43/08
See application file for complete search history.

(56) References Cited

U.S. PATENT DOCUMENTS

| | | | | |
|---|---|---|---|---|
| 10,107,274 | B2 | 10/2018 | Noui-Mehidi et al. | |
| 10,677,032 | B1 | 6/2020 | Norton | |
| 2015/0064034 | A1* | 3/2015 | Davis | E21B 43/128 210/323.1 |
| 2016/0319653 | A1* | 11/2016 | Reeves | E21B 43/38 |
| 2018/0328365 | A1* | 11/2018 | Eslinger | F04D 29/0413 |
| 2020/0308940 | A1 | 10/2020 | Hill et al. | |

FOREIGN PATENT DOCUMENTS

| | | | | |
|---|---|---|---|---|
| WO | WO-2018170002 | A1 * | 9/2018 | E21B 43/128 |
| WO | 2022043765 | A1 | 3/2022 | |

OTHER PUBLICATIONS

Gimenez, Angel et al. "Influence of the Hole Geometry on the Flow Distribution in Ventricular Catheters for Hydrocephalus" BioMedical Engineering OnLine, Apr. 2015. pp. 15-17. IWBBIO 2015 Greneda, Spain.

Foreign Communication from Related Application—International Search Report and Written Opinion of the International Searching Authority, International Application No. PCT/US2023/025745, dated Jan. 24, 2024, 12 pages.

* cited by examiner

*Primary Examiner* — Kenneth J Hansen
(74) *Attorney, Agent, or Firm* — Conley Rose, P.C.; Rodney B. Carroll

(57) ABSTRACT

An intake section for an electric submersible pump (ESP) assembly comprising an outer housing with a plurality of inflow ports distributed across an outer surface of the intake housing in a proportional pattern. The size and shape of the plurality of inflow ports within the proportional pattern are configured to distribute the inflow flowrate of fluids across the outer surface of the intake housing.

20 Claims, 6 Drawing Sheets

RADIAL INFLOW HOLE GEOMETRY

CROSS-REFERENCE TO RELATED APPLICATIONS

This application claims priority to U.S. Provisional Application No. 63/462,806, filed Apr. 28, 2023, entitled "Electrical Submersible Pump Fluid Intake Having Improved Inflow Hole Geometry", which is incorporated by reference herein in its entirety.

BACKGROUND

Drilling and completing a wellbore to recover oil and gas from a subterranean formation involves a series of construction steps designed to extract hydrocarbons efficiently and safely. The process typically begins with the selection of a drilling location based on geological studies and seismic data analysis. Once the drilling site is identified, a drilling rig is mobilized to the location.

The drilling operation commences with the drilling of the wellbore, which involves the use of a drill bit attached to the bottom of a drill string. The drill string is typically rotated, and a drilling mud, e.g., a combination of water, weighting materials, and additives, is circulated down the drill string and back up the annular space between the drill string and the wellbore walls. This process serves multiple purposes, including cooling and lubricating the drill bit, stabilizing the wellbore, and carrying rock cuttings to the surface.

Once the desired depth is reached, the drilling phase of the wellbore construction process is completed, and the wellbore can be isolated from wellbore fluids. A primary cementing operation comprises the installation of casing, also referred to as a casing string, which consists of metal tubulars, e.g., steel pipes, coupled together, placed into the wellbore, and cemented in place. The cementing operation can place a cement slurry tailored for the wellbore environment within an annular space between the casing and the wellbore. The cemented casing string provides structural integrity, prevents well collapse, and isolates different geological formations to ensure the flow of hydrocarbons from the target zone.

During the completion stage, the casing string can be opened to couple the wellbore to a target production zone, e.g., hydrocarbon bearing reservoir. The casing string can be opened via perforations or downhole tool to establish communication between the wellbore and the reservoir. For example, a perforation gun can perforate the casing string with shaped explosive charges that create channels within the formation through which oil and gas can flow into the wellbore.

The wellbore construction process can include a wellbore stimulation operation, e.g., hydraulic fracturing, to create a flow path for the hydrocarbons. For example, the wellbore stimulation operation can pump a fracturing fluid, e.g., water and sand, at a high pressure and flowrate to crack or fracture the formation and deposit sand into the cracks. The sand can prop open the fractures within the hydrocarbon bearing formation and provide a pathway to the casing string.

During the production operations, a pump system, for example, electric submersible pump (ESP) systems, may be utilized when reservoir pressure alone is insufficient to produce hydrocarbons from a well or is insufficient to produce the hydrocarbons at a desirable rate from the well. A common type of ESP system comprises a centrifugal pump, a motor, and a power cable suspended on a string of production tubing within a wellbore. The entire assembly is lowered into the wellbore, and the pump is positioned at the desired depth within the well. The power cable provides electricity to the motor, which drives the pump, facilitating the lifting and transportation of hydrocarbons to the surface. The selection of an appropriate ESP system involves considering factors such as well depth, reservoir characteristics, and desired production rates.

During the operation of an ESP system, production fluids, e.g., hydrocarbons, pass through an inlet section to the pump section to be pressurized and pumped to surface. The production fluid can comprise a variety of fluids, e.g., water and oil, gas ratios, e.g., gas to fluid ratio, and solids, e.g., sand. An inlet section that prevents solids within the production fluid from entering the inlet section of the ESP pump is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
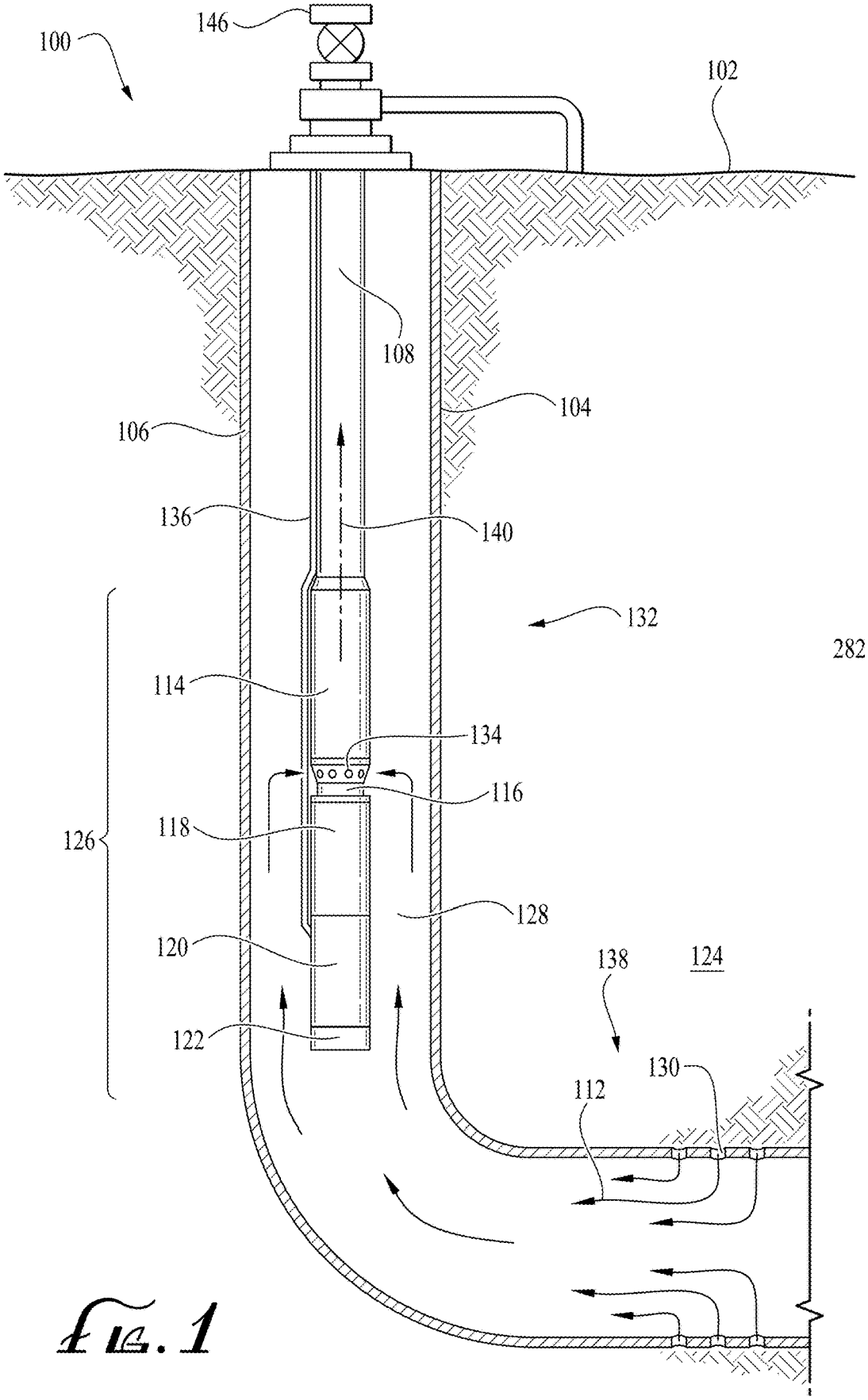
FIG. 1 is an illustration of an electric submersible pump (ESP) assembly in a wellsite environment according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

During production operations, artificial lift systems, for example, electric submersible pump (ESP) pump, may be used when reservoir pressure alone is insufficient to produce hydrocarbons from a well or is insufficient to produce the hydrocarbons at a desirable rate from the well. An ESP system is typically transported to the wellsite in sections, assembled, attached to the production tubing, and conveyed into the wellbore by the production tubing to a target depth. The typical ESP system is configured with the pump section coupled to the production tubing with the motor section downhole or below the pump section. A power cable is typically mounted or strapped along the outside of the production tubing to provide electrical power to the electric motor of the ESP system.

A typical inlet section of an ESP system can comprise a plurality of ports for the intake of production fluid. The plurality of ports can fluidically couple the pump section to the annulus located between the outer surface of the ESP system and the inner surface of the casing string. Production fluids, e.g., a mixture of oil and gas, can enter the inlet section via the plurality of ports. In some scenarios, solids may be suspended within the production fluid, for example, sand. Erosion of the pump section and the inlet ports can be caused by a high flowrate of production fluids with suspended solids entering the inlet section. A method of preventing a high flowrate of production fluids entering the inlet section is desirable.

One solution can be a hole pattern configured to distribute the intake of production fluids across the surface area of the intake section. A typical intake housing of an intake section can have a plurality of ports, e.g., drilled holes, distributed equally across the outer surface of the intake housing. The plurality of ports are typically the same size with an offset radial pattern, e.g., a port in a second row is located between two ports in the first row. This typical pattern of equally distributed ports can promote a high flowrate of production fluids entering the hole pattern proximate to the pump section and a low flowrate or no flow entering the hole pattern distal or away from the pump section. The high flow rate near the pump section can create a localized area of erosion, also referred to as a hot-spot. A proportional pattern can vary the density of the hole pattern along the outer surface of the inlet housing. For example, the plurality of ports on the outer surface of the intake section can be configured to choke or decrease the flowrate of fluids closest to the pump section and configured to be open or promote the flowrate of production fluids distal from the pump section. The proportional pattern can have a lower density of ports per unit of surface area close the pump section and a higher density of ports away from or distal to the pump section. The lower density of ports can choke or reduce the inflow flowrate of production fluids and the higher density of ports can increase or promote the inflow flowrate of production fluids through the inlet housing.

Another solution can include varying the size of the ports. A typical intake housing can include a plurality of ports of the same size or diameter. For example, an intake housing may comprise a pattern of a plurality of holes drilled with a 9.5 mm or ⅜ inch drill size. The plurality of holes may be the same size throughout the pattern. A proportional pattern of ports may comprise a variety of port or hole sizes that are dependent on the location within the pattern. For example, a portion of the ports proximate or nearest to the pump section may be a smaller size, e.g., 6 mm or ¼ inch drill size and a portion of the ports distal or away from the pump section may be a larger size, e.g., 12.5 mm or 0.5 inch drill size. The proportional pattern of ports can choke or reduce the inflow flowrate of production fluids through the smaller size ports and can increase or promote the inflow flowrate of production fluids through the larger size ports. The proportional pattern of ports can include two, three, four, or more sizes of ports, e.g., drill sizes.

Still another solution can be a filter media sized to prevent or reduce a size of solid particles entering the intake section. A filter media can be placed or wrapped around the circumference of the outer surface with the plurality of ports. The filter media can be a welded screen, a woven mesh, a metal filter with laser cut holes, or any combination thereof. The solid particles can comprise variety of types of materials and a range of particle sizes. The subterranean formation may produce a range of particle types and sizes.

A fluid distribution and filtering system can reduce the intake of solids by reducing the flowrate and filtering out solids. The proportional pattern can vary the density of ports, the size of the ports, the shape of the ports, or combinations thereof along the outer surface of the inlet housing. The proportional pattern of ports can decrease the inflow flowrate of production fluids by distributing the inflow flowrate of production fluids across the entire outer surface of the intake housing. The filter media can exclude a range of particle sizes. The fluid distribution and filtering system can reduce the production of solids by slowing the inflow flowrate and excluding a range of particle sizes from the production fluids flowing into the intake section.

When the ESP system is used in high flow and/or high heat applications such as steam assisted gravity drain (SAGD) wells or in geothermal wells, fluid flow distribution and pressure drop across the ESP wellbore fluid intake may affect system run life. With the aid of the present disclosure, the ESP fluid intake can be configured to (i) balance flow across an axial length thereof, (ii) minimize pressure drops across the inflow holes, (iii) screen the inflow holes to prevent solids entering the pump, and (iv) any combination of (i)-(iii).

As disclosed in detail herein, (a) hole geometry, (b) position, (c) angle, and (d) spacing are provided to (i) balance flow and/or (ii) reduce pressure drop of fluid when entering the fluid intake of the ESP system all while (iii) screening solids from entering the pump. The novel intakes described herein comprise a plurality of inflow holes that are not uniform regarding spacing, diameter, angle, draft, shape, or combinations thereof. For example, one or more of the parameters (e.g., spacing, diameter, angle, draft, and/or shape) are varied axially on the fluid intake (e.g., varied across the axial distance or length of the fluid intake).

Turning now to FIG. 1, a wellsite environment 100 is illustrated. In some embodiments, wellsite environment 100 comprises a wellbore 104 extending from a surface 102 to a permeable formation 124. The wellbore 104 can be drilled from surface 102 using any suitable drilling technique. The wellbore 104 can include a substantially vertical portion 132 that transitions to a deviated portion and into a substantially horizontal portion 138. In some embodiments, the wellbore 104 may comprise a nonconventional, horizontal, deviated, multilateral, or any other type of wellbore. Wellbore 104 may be defined in part by a casing string 106 that may extend from a surface 102 to a selected downhole location. Portions of wellbore 104 that do not comprise the casing string 106 may be referred to as open hole. While the wellsite environment 100 illustrates a land-based subterranean environment, the present disclosure contemplates any wellsite environment including a subsea environment. In one or more embodiments, any one or more components or elements may be used with subterranean operations equipment located on offshore platforms, drill ships, semi-submersibles, drilling barges, and land-based rigs.

In some embodiments, various types of hydrocarbons and fluids 112 may be pumped from wellbore 104 to the surface 102 via the production tubing 108 using an electric submersible pump (ESP) assembly 126 disposed or positioned downhole, for example, within, partially within, or outside casing string 106 of wellbore 104. The ESP assembly 126 can be located within the vertical portion 132, the deviated portion, the horizontal portion 138, or combination thereof, e.g., a transitional portion. The ESP assembly 126 may comprise various assemblies or sub-assemblies referred to as sections including a pump section 114, an intake section 116, a seal section 118, a motor section 120, and a sensor package 122. In some embodiments, the pump section 114 may comprise one or more centrifugal pump stages, each centrifugal pump stage comprising an impeller mechanically coupled to a drive shaft and a corresponding diffuser held stationary by and retained within the centrifugal pump assembly (e.g., retained by a housing of the centrifugal pump assembly). In some embodiments, the pump section 114 may not contain a centrifugal pump but instead may comprise a rod pump, a piston pump, a progressive cavity pump, or any other suitable pump system or combination thereof.

The pump section 114 may transfer pressure to the production fluid 112 or any other type of downhole fluid to pump or lift the fluid 112 from the downhole reservoir to the surface 102 at a desired or selected pumping rate. In one or more embodiments, fluid 112 may enter the wellbore 104, casing string 106 or both through one or more perforations 130 in the permeable formation 124 and flow uphole to the intake section 116 of the ESP assembly 126. In some embodiments, the intake section 116 includes at least one port or inlet 134 for the production fluid 112 within the wellbore 104 to enter into the ESP assembly 126. The intake section 116 can be fluidically connected to the annulus 128 for the transfer of production fluids 112 to the pump section 114. In some embodiments, the intake section 116 can be configured to intake a production fluid 112 with a mix of liquid phase and gas phase, separate the liquid portion, expel the gaseous portion, and transfer the liquid portion to the pump section 114. The centrifugal pump stages within the pump section 114 may transfer pressure to the fluid 112 by adding kinetic energy to the wellbore fluid 112 via centrifugal force and converting the kinetic energy to potential energy in the form of pressure. In one or more embodiments, pump section 114 lifts the pressurized fluid 140 to the surface 102. In some contexts, the wellbore fluid 112 may be referred to as reservoir fluid. The wellbore fluid 112 may flow downstream (or upstream depending on the location of the inlet 134 relative to the perforations 130) towards the ESP assembly 126 and into the intake section 116. The wellbore fluid 112 may comprise a liquid phase fluid, a gas phase fluid, or both (e.g., a mixed-phase fluid). The wellbore fluid 112 may comprise hydrocarbons such as crude oil and/or natural gas. The wellbore fluid 112 may comprise water. In a geothermal application, the well fluid 112 may comprise hot water.

In some embodiments, a motor section 120 can include a drive shaft and an electric motor. In some embodiments, an power cable 136 can be coupled to the electric motor of the motor section 120 and to a controller at the surface 102. The power cable 136 can provide power and communication to the electric motor, transmit one or more control or operation instructions from controller to the electric motor, or both. In some embodiments, the electric motor may be a two pole, three phase squirrel cage induction motor, a permanent magnet motor (PMM), a hybrid PMM (induction and PMM combined) or any other electric motor operable or configurable to provide rotational power.

In some embodiments, the rotational power of the motor section 120 can be transferred from the motor section 120 to the pump section 114 via a drive shaft. A drive shaft within the motor section 120 can rotationally couple to a drive shaft within the seal section 118. The drive shaft within the seal section 118 can rotationally couple to a drive shaft within the intake section 116. The drive shaft within the intake section can rotationally couple to the drive shaft within the pump section 114. The rotational power of the motor section 120 can be transferred to the pump section 114 via a plurality of drive shafts rotationally coupled together.

Figure 2:
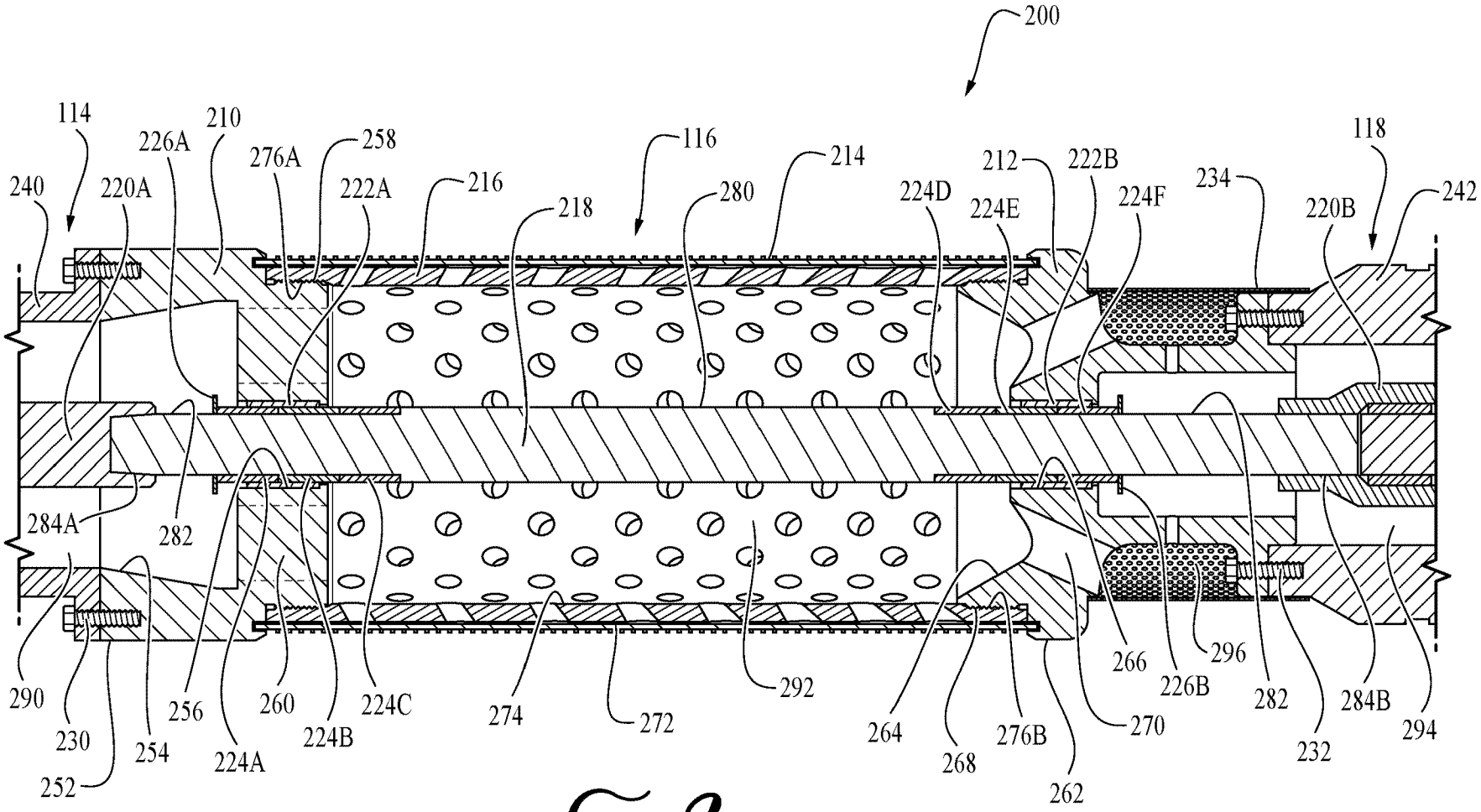
FIG. 2 is a partial cross-sectional view of an intake section according to an embodiment of the disclosure.

As previously described, the intake section 116 can be coupled between the pump section 114 and the seal section 118. Turning now to FIG. 2, a portion 200 of the ESP assembly 126 with the intake section 116 is described. The intake section 116 comprises an intake head 210, an intake base 212, an intake jacket 214, an intake housing 216, and a drive shaft 218. The intake head 210 can be a generally cylindrical shape with an outer surface 252, an inner surface 254, a bearing surface 256, an outer receiving surface 258, and at least one inner passage 260. The intake base 212 can be a generally cylindrical shape with an outer surface 262, an inner surface 264, a bearing surface 266, an outer receiving surface 268, and one or more passages 270, also referred to as debris ports. The intake housing 216 can be a generally cylindrical shape with an outer surface 272, an inner surface 274, an inner receiving surface 276, and a plurality of inflow ports 278. The intake housing 216 can be mechanically coupled, e.g., threaded, to the intake head 210 and intake base 212. For example, the inner receiving surfaces 276A-B of the intake housing 216 can be mechanically coupled to the outer receiving surface 258 of the intake head 210 and the outer receiving surface 268 of the intake base 212 respectively. The drive shaft 218 can be rotationally coupled to the intake head 210 by a shaft bushing 222A and to the intake base 212 by a shaft bushing 222B. The drive shaft 218 can be generally rod shaped with an outer surface 280, a bushing surface 282, and an outer coupling surface 284. The outer coupling surface can be a splined outer surface or a threaded outer surface. In some embodiments, the drive shaft 218 includes one or more sleeve spacers 224 coupled to the drive shaft 218 by at least one retaining ring 226. The sleeve spacers 224 are generally cylindrical shape with an inner surface 286 configured for a sliding fit over the bushing surface 282 of the drive shaft 218. Although the drive shaft 218 is illustrated with three sleeve spacers 224A-C located proximate to the pump section 114 and three sleeve spacers 224D-F located proximate to the seal section 118, it is understood that the drive shaft 218 can comprise 1, 2, 3, 4, 5, 6, 7, 8, 9, 10, 11, 12, or any number of sleeve spacers 224. An intake chamber 292 can be formed between the inner surface 274 of the intake housing 216 and the outer surface 280 of the drive shaft 218. The intake chamber 292 can be fluidically coupled to the annulus 128 via a plurality of inflow ports.

The intake section 116 can be coupled to the pump section 114 and seal section 118 by a bolted connection. For example, a pump section flange 240 of the pump section 114 can be sealingly coupled to the intake head 210 by a seal and a plurality of retaining bolts 230. A suction chamber 290 can be formed between the inner surface of the pump section flange 240 and the outer surface of the coupling assembly 220A. The suction chamber 290 can be fluidically coupled to the intake chamber 292 via one or more inner passages 260.

A seal section head 242 can be sealingly coupled to the intake base 212 by a seal and a plurality of retaining bolts 232. Although the pump section 114 and seal section 118 are described as coupled to the intake section 116 with a bolted connection, e.g., a plurality of retaining bolts, it is understood that the pump section 114 and seal section 118 can be mechanically coupled to the intake section 116 by any mechanical mechanism, for example, a welded connection, a threaded connection, a pinned connection, a bolted connection, or combinations thereof. A seal chamber 294 can be formed between the inner surface of the seal section head 242 and the outer surface of the coupling assembly 220B. The seal chamber 294 can be fluidically coupled to the annulus 128 by one or more ports (not shown).

The drive shaft 218 of the intake section 116 can be rotationally coupled to a drive shaft of the pump section 114 and the seal section 118. The drive shaft 218 can be rotationally coupled to the drive shaft of the pump section 114 by a coupling assembly 220A and to the drive shaft of the seal section 118 by a coupling assembly 220B. The outer surface 284A-B of the drive shaft 218 can include splines, threads, grooves, or combinations thereof. The coupling assembly 220 can be configured to couple a first drive shaft, e.g., drive shaft 218, to a second drive shaft, e.g., seal section drive shaft, with two connection types, e.g., splines, threads, or grooves. For example, the coupling assembly 220 can threadingly couple to the drive shaft 218 of the intake section and rotationally couple to a spline outer surface of the seal section drive shaft, or vise versa. The coupling assembly 220 can be configured to rotationally transmit torque and rotational motion from a first drive shaft, e.g., drive shaft 218, to a second drive shaft, e.g., seal section drive shaft and/or pump section drive shaft.

In some embodiments, an intake jacket 214 can be installed over the intake housing 216. The intake jacket 214 can comprise a filter media configured to exclude a range of sizes of solid particulates within the production fluid. The filter media can comprise a wire wrap screen, a slotted screen, a perforated screen, a wire mesh screen, a stack of rings, a drainage layer, a shroud, or combinations thereof. The wire wrap screen can comprise a round or shaped wire wound and welded to support ribs forming a plurality of wire wraps. A slotted screen can include a plurality of vertical or horizontal slots cut into a tubular member. The perforated screen can comprise a plurality of evenly spaced holes cut and/or drilled into a tubular member. The wire mesh can be formed by a plurality of wires woven together to form a consistent gap between wires. The ring can be configured with a spacer feature that forms a predetermined space between the stack of rings. A drainage layer can be formed by placing a first filter media, e.g., a wire wrap screen, under a second filter media, e.g., a wire mesh screen. A shroud can be formed by placing a third filter media, e.g., a perforated screen or a slotted screen, over a first filter media, e.g., a woven screen. The range of solid particles filtered by the filter media can be determined by a) space between the wire wraps, b) the width of the plurality of slots, c) the diameter of a plurality of holes, d) a space formed between woven mesh of wires, e) the gap between each of the stack of rings, or f) combinations thereof.

In some embodiments, a filter screen 234 can be installed between the intake base 212 of the intake section 116 and the seal section 118. The filter screen 234 can be a perforated screen with evenly spaced holes. The filter screen 234 can be formed of two parts that are coupled together by welding or with a set of fasteners, e.g., bolts, screws, or bands. Although the filter screen 234 is illustrated as a perforated screen, it is understood that the filter screen 234 could be formed of any type of filter media, for example a wire wrap screen. A lower intake chamber 296, e.g., a second intake chamber, can be formed between an outer surface of the intake base 212 and the inner surface of the filter screen 234.

Figure 3A:
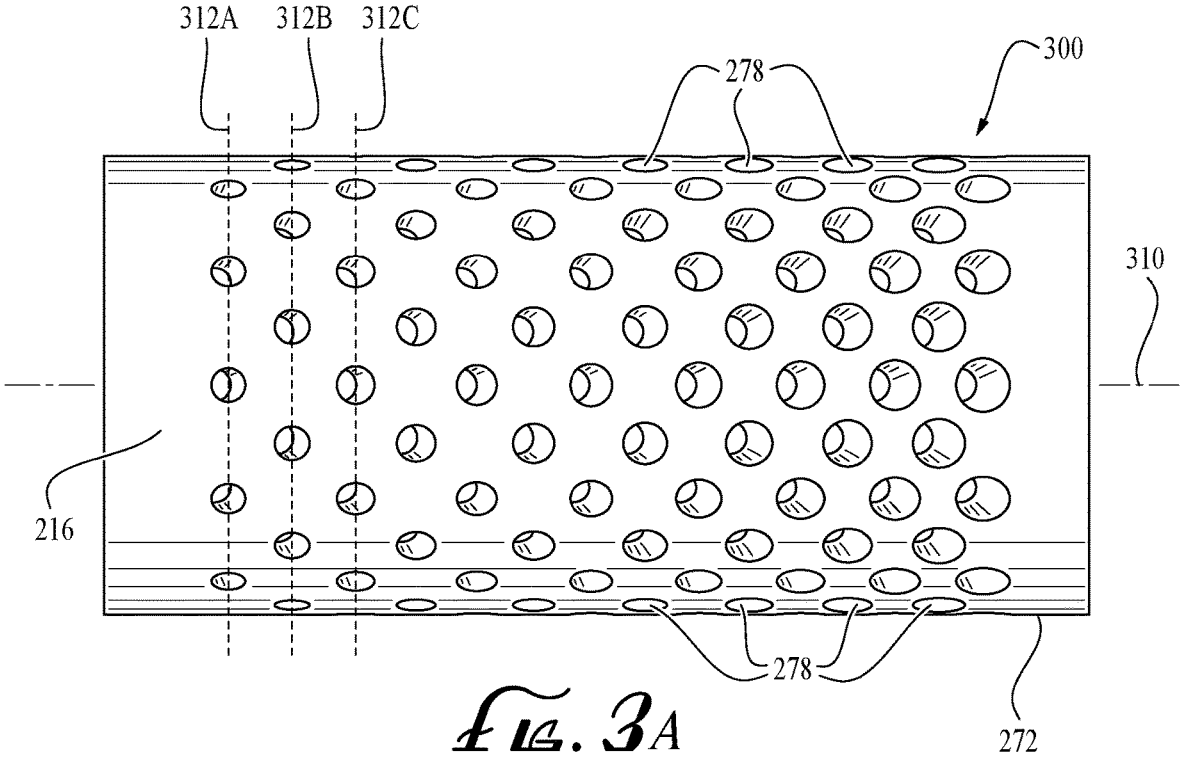
FIG. 3A is a front view of an intake housing according to an embodiment of the disclosure.
Figure 3B:
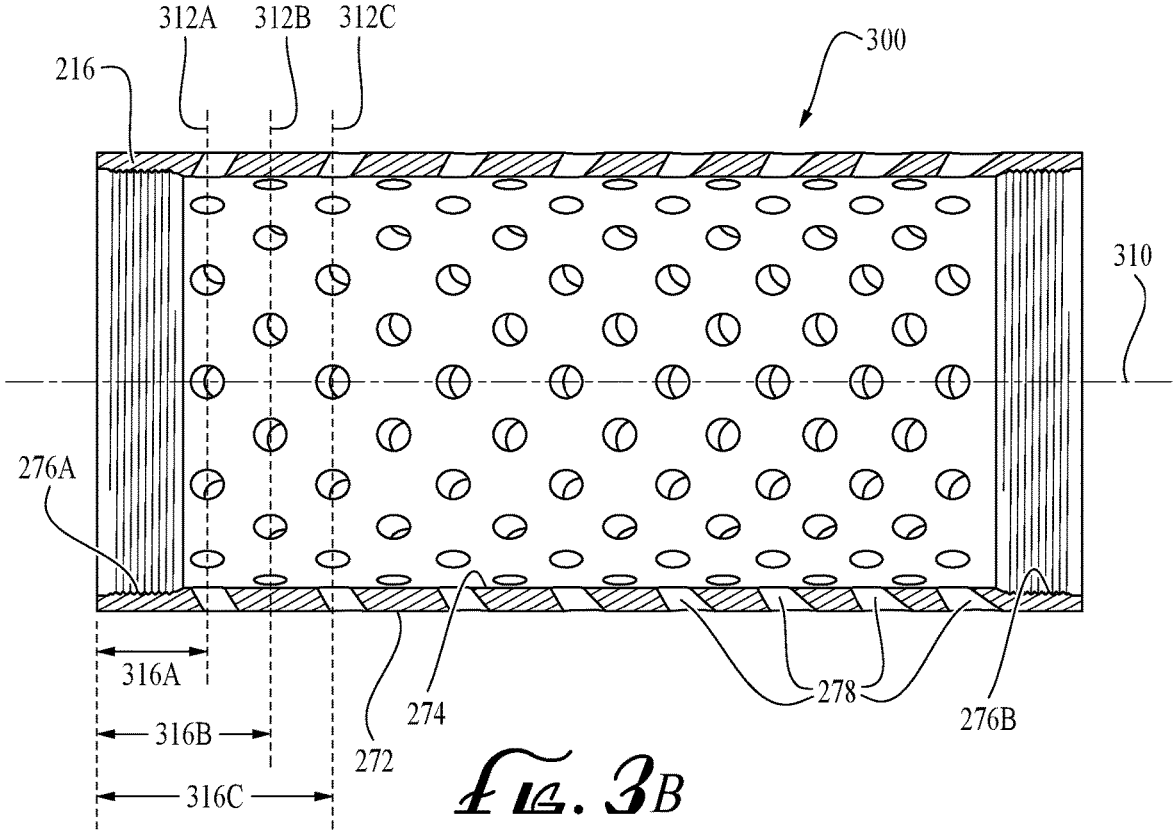
FIG. 3B is a partial cross-sectional view of the intake housing according to an embodiment of the disclosure.

The intake housing 216 of the intake section 116 can comprise a plurality of ports formed in a proportional pattern to distribute the inflow of production fluids. Turning now to 3A and 3B, a proportional pattern 300 on an outer surface of the intake housing 216 can be described. In some embodiments, the inflow ports 278, e.g., inflow holes, can be arranged in circumferential bands 312 where a given number of inflow ports 278 are evenly radially spaced (spaced about equidistantly) about the circumference, e.g., the outer surface 272, of the intake housing 216 at a given (discrete) location 316 (e.g., a given axial location/distance) along the central axis of the housing. In the exemplary intake housing 216, the outer surface 272 can include 15 circumferential bands 312 of inflow ports 278 configured in a cross-sectional plane perpendicular to a central axis 310. For example, six 6 circumferential bands 312A-F of inflow ports 278 can be located in the upper half of intake housing 216 (e.g., left of the axial midpoint), and nine circumferential bands 312G-O of inflow ports 278 can be located along the lower half of the housing (e.g., right of the axial midpoint). As shown in FIGS. 3A-B, the number of inflow ports 278, e.g., holes, per unit of surface area of the inner surface 274 and/or outer surface 272 of the intake housing 216 (e.g., holes per square meter) displays a gradated or stratified increase from left to right, or from the end proximate the pump section 114 to the end proximate the seal section 118. As shown in FIGS. 3A-B, the circumference of each hole, e.g., inflow port 278, on the inner surface 274 of the housing (e.g., the inner hole circumference) and the circumference of each hole in the outer surface 272 of the housing (e.g., the outer hole circumference) are the same shape (e.g., circular), but may be of different size (thereby providing a draft angle) and the inner and outer circumferences may be offset from each other along the central axis (thereby providing a skew angle). In an embodiment, the size and shape of the inner hole circumference is the same for equal to or greater than 50, 60, 70, 80, 90, 95, or 100% of the inflow ports 278. In an embodiment, the size and shape (e.g., circular) of the inner hole circumference is the same for equal to or greater than 50, 60, 70, 80, 90, 95, or 100% of the inflow ports 278, and the outer hole circumference size is greater than the inner hole circumference and the shape is the same as the inner hole circumference. The plurality of inflow ports 278 can fluidically couple the intake chamber 292 to the annulus 128.

Figure 4A:
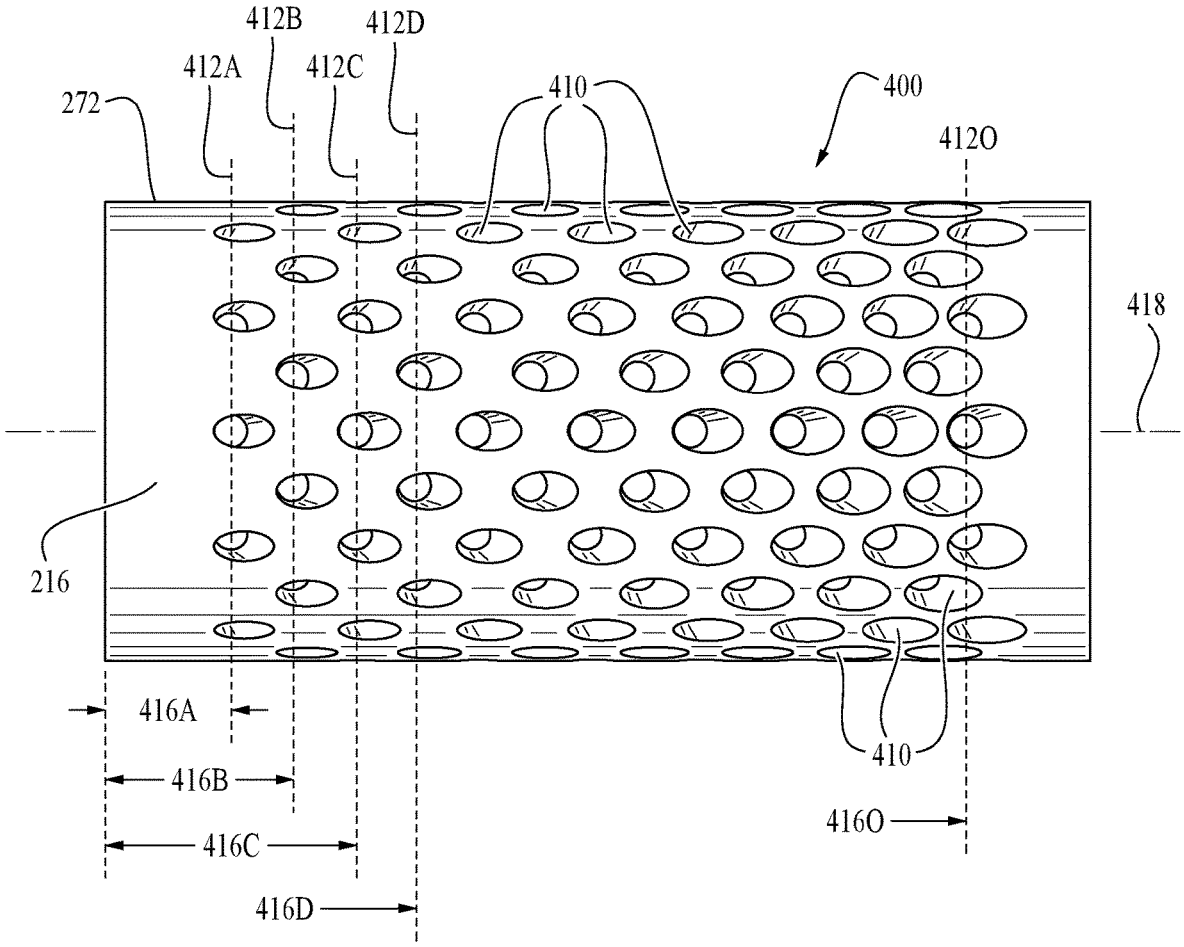
FIG. 4A is a front view of an intake housing according to another embodiment of the disclosure.
Figure 4B:
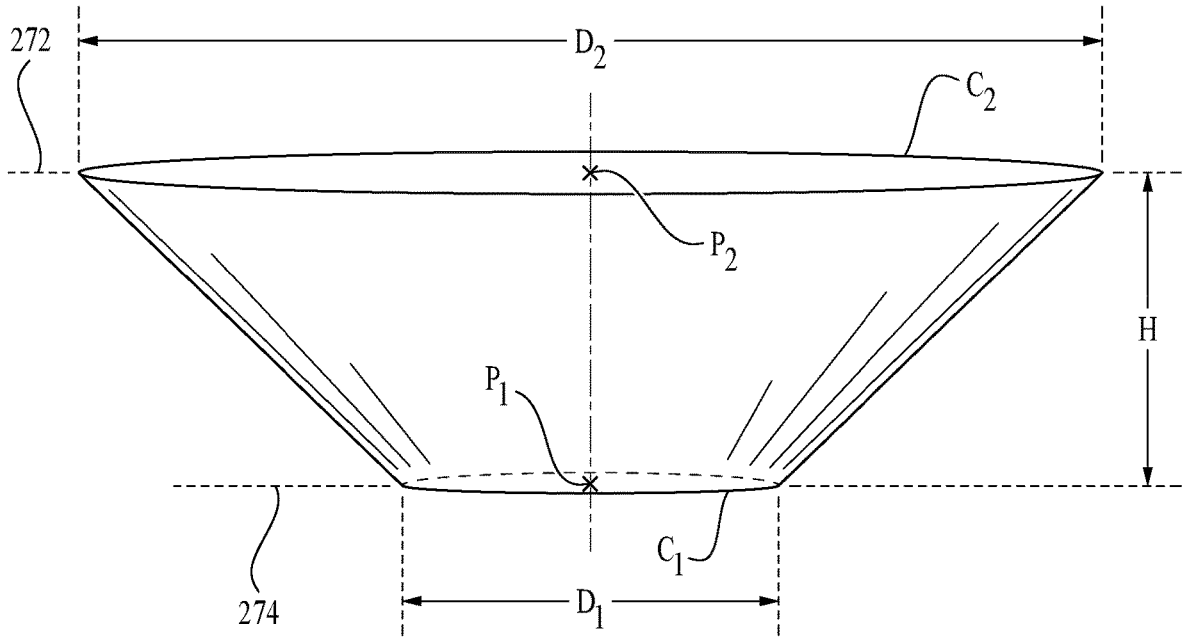
FIG. 4B is a side view of an inflow port from the intake housing according to another embodiment of the disclosure.
Figure 4C:
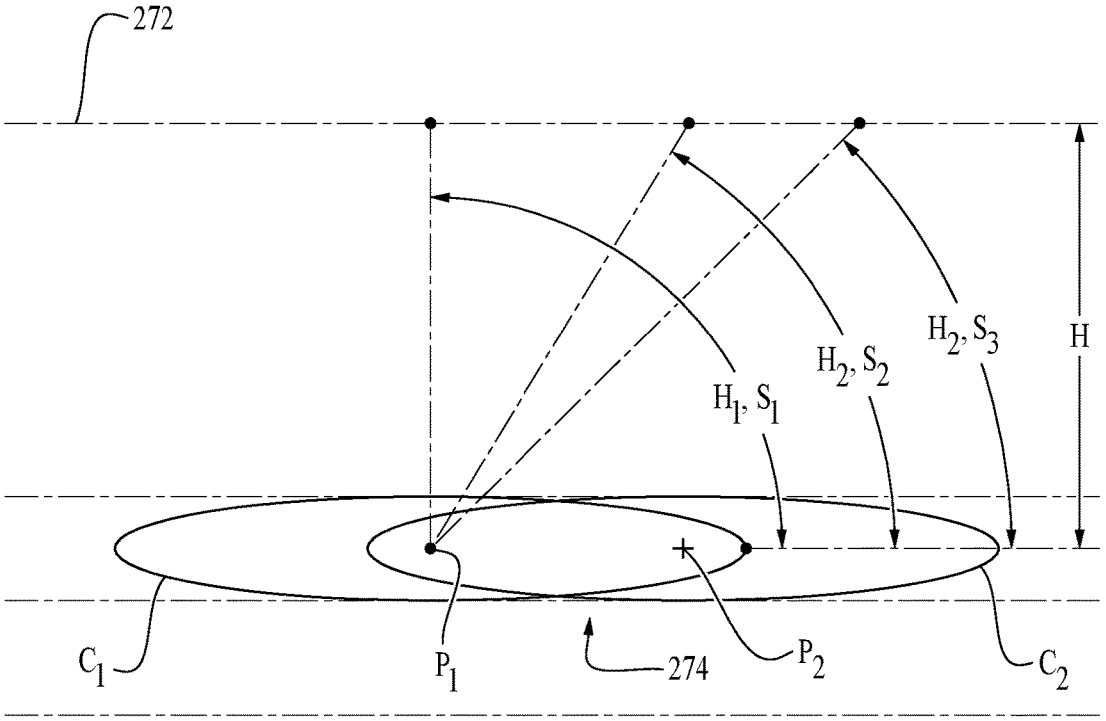
FIG. 4C is a projected detail view of the inflow port from the intake housing according to another embodiment of the disclosure.

The inflow ports along the outer surface of the intake section 116 can include a variety of shapes or forms. Turning now to FIG. 4A-D, a proportional pattern 400 with an alternative inflow port along an outer surface of the intake housing 216 can be described. In some embodiments, the inflow ports 410, e.g., holes, can be arranged in circumferential bands 412 where a given number of inflow ports 410 are evenly radially spaced (spaced about equidistantly) about the circumference, e.g., the outer surface 272, of the intake housing 216 at a given (discrete) location 416 (e.g., a given axial location/distance) along the central axis 418 of the intake housing 216. In the exemplary intake housing 216, the outer surface 272 can include 15 circumferential bands 412A-O of inflow ports 278 configured in a cross-sectional plane perpendicular to a central axis 418. As shown in FIG. 4B, the circumference C1 of each hole, e.g., inflow port 278, on the inner surface 274 of the housing (e.g., the inner hole circumference) and the circumference C2 of each hole in the outer surface 272 of the housing (e.g., the outer hole circumference) are the same shape (e.g., circular), but may be of different size. The hole in the inner surface 274 can have a circular shape with a diameter D1 and a corresponding circumference C1. The hole in the outer surface 272 can have a circular shape with a diameter D2 and a corresponding circumference C2. The center point of the hole in the outer surface 272 can radially align or be coincident with the center point of the hole in the inner surface 274 at a height of H1. As the height H or distance from the outer surface 272 to the inner surface 274 decreases, the circumference C2 (and corresponding diameter D2) decreases or the center points of the circumferences are not aligned. As shown in FIG. 4C, a skew angle, also referred to as a tilt angle, decreases as the distance H from the outer surface 272 to the inner surface 274 decreases. A first skew angle S1 can be 90 degrees when H is equal to H1 as shown in FIG. 4B. A second skew angle S2 can be 60 degrees when H is equal to H2. A third skew angle S3 can be 45 degrees when H is equal to H3. Although the skew angle S1, S2, and S3 is described as a function of H (e.g., determined by H), it is understood that the skew angle can be determined by manufacturing process, for example, programmed on a milling machine.

Figure 4D:
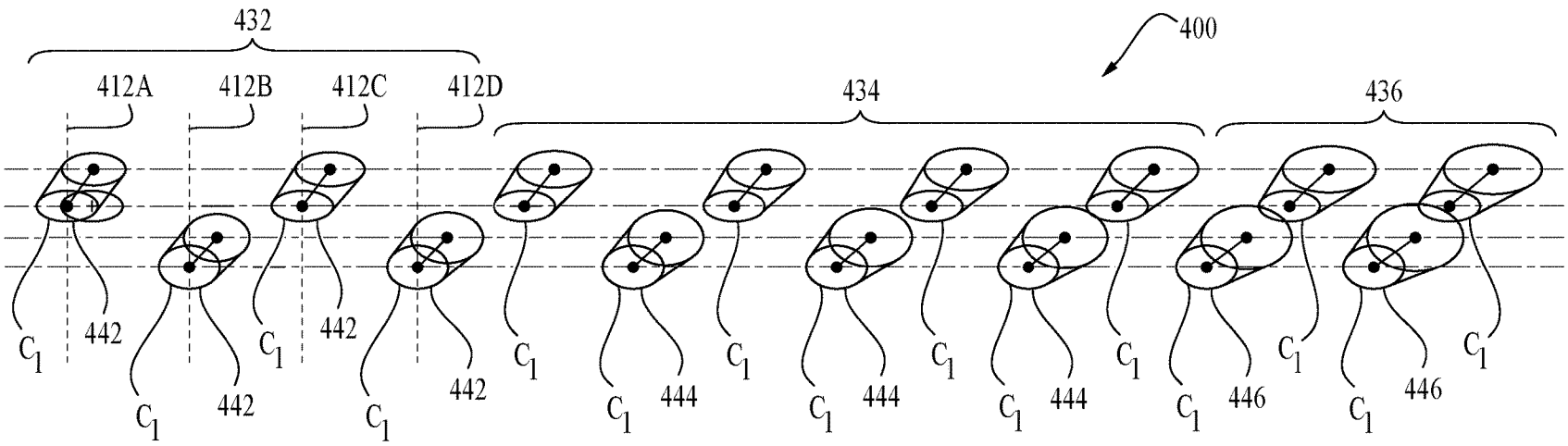
FIG. 4D is a side view of a portion of the pattern of inflow ports from the intake housing according to another embodiment of the disclosure.

Turning now to FIG. 4D, a portion of a proportional pattern of inflow ports can be described. In some embodiments, a proportional pattern 400 of inflow ports, e.g., holes, can include a first set 432 of inflow ports, a second set 434 of inflow ports, and a third set 436 of inflow ports. In the exemplary proportional pattern 400, the first set 432 of inflow ports can include four circumferential bands 412A-D of inflow ports 442 comprising a circumference C1 on the inner surface and a first skew angle A1. The second set 434 of inflow ports can include seven circumferential bands 412E-K of inflow ports 444 comprising a circumference C1 on the inner surface and a second skew angle A2. The third set 436 of inflow ports can include four circumferential bands 412L-O of inflow ports 446 comprising a circumference C1 on the inner surface and a third skew angle A3. In the exemplary proportional pattern 400, the first skew angle A1 can be greater than the second skew angle A2 which can be greater than the third skew angle A3.

Figure 4E:
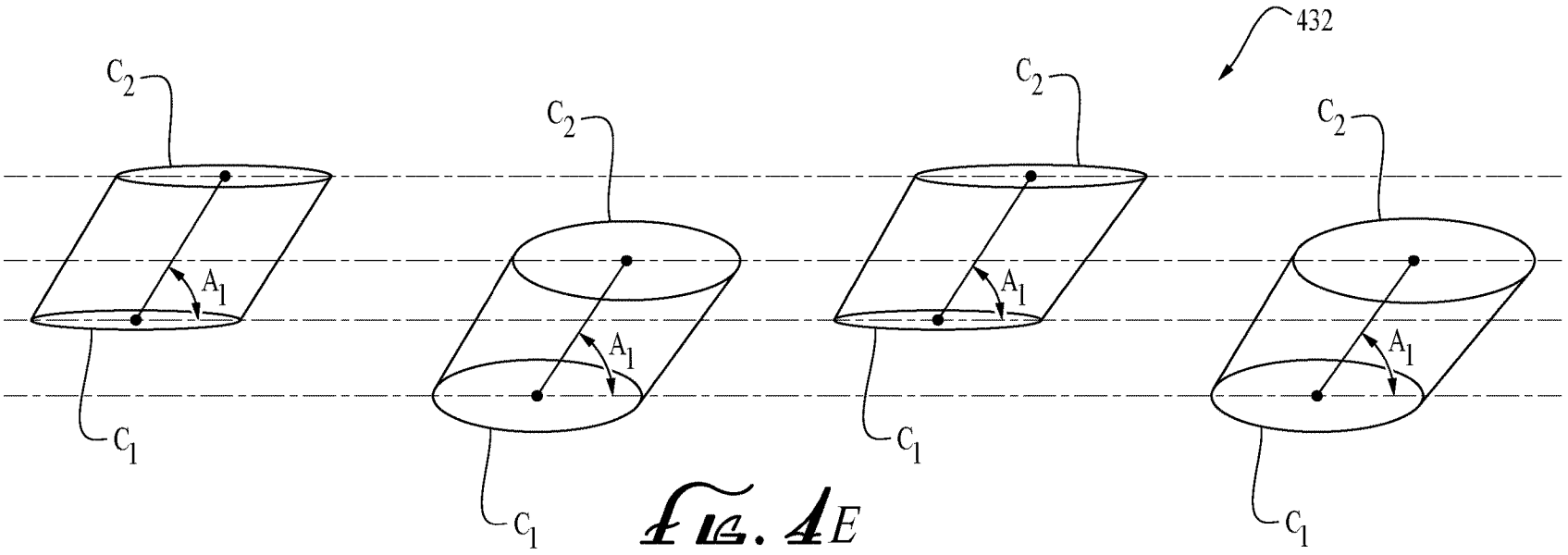
FIG. 4E is a side view of a first group of inflow ports from the intake housing according to another embodiment of the disclosure.

Turning now to FIG. 4E, the first set 432 of the proportional pattern 400 of inflow ports 442 can be described. In some embodiments, the inflow ports 442 comprise a circumference C1 along the inner surface, e.g., inner surface 274, a circumference C2 along the outer surface 272, and a skew angle A1. In the exemplary first set 432 of the proportional pattern 400, the first set 432 can include four circumferential bands 412A-D of inflow ports 442.

Although the proportional pattern 300, 400 is described with three sets of inflow ports and 15 circumferential bands, it is understood that the outer surface 272 of the intake housing 216 can comprise 1, 2, 3, 4, 5, 6, 7, 8, 9, 10, 11, 12, 13, 14, 15, 16, 17, 18, 19, 20, 21, or any number of circumferential bands 312, 412 of inflow ports. Although the proportional pattern 300, 400 is described with three sets of circumferential bands, e.g., first set 432, it is understood that the outer surface 272 of the intake housing 216 can comprise 1, 2, 3, 4, 5, 6, 7, 8, 9, 10, 11, 12, 13, 14, 15, 16, 17, 18, 19, 20, 21, or any number of sets of circumferential bands comprising a given skew angle, e.g., skew angle A1. Although the proportional pattern 300, 400 is described with a plurality of inflow ports with a circumference C1 on the inner surface, e.g., inner surface 274, of the intake housing 216 it is understood that the inner surface 274 of the intake housing 216 can comprise 1, 2, 3, 4, 5, 6, 7, 8, 9, 10, 11, 12, 13, 14, 15, 16, 17, 18, 19, 20, 21, or any number of circumferences, e.g., C1, of inflow ports or holes.

An ESP assembly 126 using the proportional pattern along the outer surface of the intake housing 216 of the intake section 116 can be utilized for producing wellbore fluids to the surface. In some embodiments, a method of lifting a production fluid in a wellbore to surface can be performed by operating an electric motor within a motor section 120, as described above, having the proportional pattern 300 of inflow ports 278 along the outer surface 272 of the intake housing 216 of the intake section 116. The ESP assembly, e.g., ESP assembly 126, can be transported to a remote wellsite with the sections in a disassembled or partially disassembled state.

The ESP assembly comprises a pump section, e.g., pump section 114, an intake section, e.g., intake section 116, a seal section, e.g., seal section 118, and a motor section, e.g., motor section 120. The electric motor comprises a drive shaft, at least one rotor, at least one stator, and a housing. The ESP assembly can be assembled at the remote wellsite by mechanically coupling the disassembled sections into an assembled state.

The ESP assembly can be coupled to a production tubing, e.g., production tubing 108. The production tubing can be tubular pipes threadingly coupled together, a continuous tubing string, e.g., coil tubing, or combinations thereof. The ESP assembly can be electrically coupled to a controller, for example, the motor section of the ESP assembly can be coupled to a controller at surface via an electric cable or power cable 136. The ESP assembly can be conveyed into the wellbore 104 via the production tubing 108.

The ESP assembly can be actuated or powered by providing electric power, via a surface controller, to the electric motor of the motor section 120 of the ESP assembly via the power cable 136. The electric motor can apply torque and rotational motion to the drive shaft located in the motor section 120. The drive shaft within the motor section 120 can be rotationally coupled to the drive shaft within the pump section 114 via the drive shaft within the seal section 118 and the drive shaft 218 within the intake section 116. Torque and rotational motion within the pump section 114 can create a positive head pressure and lift or pump the fluids within the plurality of pump stages, e.g., impeller within diffuser, and draw fluid into the pump section 114 with net positive suction head to replace the fluid exiting the plurality of pump stages. The suction head can generate a pressure differential between the wellbore fluid, e.g., production fluid 112, within the annulus 128 (higher pressure) and the fluid within the suction chamber 290 (lower pressure). The suction head, e.g., pressure differential, can draw fluid, e.g., production fluid 112, into a suction chamber 290 from the intake chamber 292 via the one or more inner passages 260. The wellbore fluids within the annulus 128 can flow into the intake chamber 292 vis the plurality of inflow ports 278 or inflow ports 410. Said another way, the suction head generated from the pump section 114 can draw production fluid 112 i) from the reservoir 124 into the annulus 128 via the perforations 130, ii) from the annulus 128 into the intake chamber 292 vis the plurality of inflow ports 278, iii) from the intake chamber 292 into the suction chamber 290 via the one or more inner passages 260, and into the pump, e.g., multistage centrifugal pump, from the suction chamber 290.

In some embodiments, a pattern 300, 400 can distribute the flowrate of fluids across the plurality of inflow ports 278, 410 located along the outer surface 272 and/or inner surface 274 of the intake housing 216. For example, the flowrate of fluid through each of the bands 312A-O of the pattern 300 of inflow ports 278 can be generally equivalent or approximately the same. In another scenario, the flowrate of fluid through each of the bands 412A-O of the pattern 400 of inflow ports 410 can be generally equivalent or approximately the same. In still another scenario, the flowrate of fluid through each of the first set 432, the second set 434, and the third set 436 of the pattern 400 of inflow ports 410 can be generally equivalent or approximately the same.

In some embodiments, the suction chamber 290 can receive a portion of the flowrate of production fluids from the lower intake chamber 296 via the one or more passages 270. For example, the suction chamber 290 can receive 0%, 1%, 2%, 3%, 4%, 5%, 6%, 7%, 8%, 9%, 10%, 11%, 12%, or more of the flowrate of production fluids, e.g., production fluids 112. In a scenario, the lower intake chamber is static, e.g., non-flowing, and the suction chamber 290 receives zero flowrate from the lower intake chamber 296.

In some embodiments, the lower intake chamber 296 can expel debris into the annulus 128. Solid particles can accumulate within the intake chamber 292 from the inflow of production fluids through the intake jacket 214 and plurality of inflow ports 278, 410. The solid particles, e.g., sand and scale, can separate from the inflow of fluids and settle or fall to the downhole end of the intake chamber 292, e.g., proximate the seal section 118. These solid particles within the intake chamber, also referred to as flowback particles, can pass through the one or more passages 270 to the lower intake chamber 296. In some embodiments, during the inflow of production fluids from the suction head within the suction chamber 290, the lower intake chamber 296 is static, e.g., non-flowing, and the flowback particles settle or fall through the one or more passages 270 into the lower intake chamber 296 and out through the filter screen 234 into the annulus 128. In some embodiments, the flowback particles settle or fall into i) the downhole portion of the intake chamber 292, ii) the inner surface of the housing 216, iii) the one or more passages 270, iv) the lower intake chamber 296, or v) combinations thereof. The flowback particles can be discharged or fall out through the filter screen 234 from one or more of the interior locations to the annulus 128 upon stopping operation of the pump.

The production fluid can be lifted by the ESP assembly while located in a downhole environment having a temperature in the range from 25 degrees Celsius to 100 degrees Celsius, from 100 degrees Celsius to 150 degrees Celsius, from 150 degrees Celsius to 200 degrees Celsius, from 200 degrees Celsius to 280 degrees Celsius, or from 280 degrees Celsius to 350 degrees Celsius. The production fluid can be lifted, or pumped to surface, by the ESP assembly while located in a downhole environment having a temperature in the range from 280 degrees Celsius to 350 degrees Celsius.

In an embodiment, the lifting of production fluids by the ESP assembly while located in a downhole environment can include a temperature range of 280 degrees Celsius to 400 degrees Celsius, a range of 280 degrees Celsius to 450 degrees Celsius, a range of 280 degrees Celsius to 500 degrees Celsius, or a range of 280 degrees Celsius to 550 degrees Celsius. In an embodiment, a high temperature limitation for operation of the ESP assembly may be established not by the graphite rings but instead by other components in the electric motor such as the dielectric oil in the electric motor.

In an embodiment, an ESP assembly having an improved fluid intake section 116 of the type disclosed herein can be used in a Steam-Assisted Gravity Drainage (SAGD) well system (e.g., a producer well), which is an enhanced oil recovery technique designed to extract heavy oil and bitumen from underground reservoirs. This method is particularly useful for extracting resources from oil or tar sands, where conventional methods are not as effective due to the high viscosity and density of the hydrocarbons. A SAGD well system typically includes an injector well and a producer well, which form a well pair in a horizontal orientation, separated by a certain vertical distance. Steam is injected into the reservoir through the injector well, creating a steam chamber that heats and mobilizes the heavy oil or bitumen. The mobilized oil and steam condensate drains into the producer well and is transported to the surface (e.g., via an ESP assembly having an improved fluid intake section 116 of the type described herein), where it is further processed to separate hydrocarbon from the condensate.

The downhole environment may have a high temperature continuously or the temperature may reach into the high temperature range under certain infrequent but notwithstanding predictable circumstances. For example, in a SAGD downhole environment, temperature may remain in a first temperature range during normal operations, but when steam undesirably breaks into the main production wellbore (e.g., passes from the steam bearing wellbore parallel into the production wellbore), the downhole temperature may enter into a second higher temperature range. While steam breaking into the main production wellbore (e.g., into wellbore 104 of FIG. 1) may be infrequent, it can be expected to happen from time to time, and it may be desirable under this eventuality that the electric motor within the motor section 120 be able to survive and operate in this circumstance.

In a geothermal production environment, the downhole temperature may remain continuously in a high temperature range. In an embodiment, an ESP assembly having an improved fluid intake section 116 of the type disclosed herein can be used in a geothermal well system. A geothermal well system may include one or more injector wells and one or more producer wells designed to harness geothermal energy from the earth's subsurface. This type of system, often referred to as an Enhanced Geothermal System (EGS) or Hot Dry Rock (HDR) system, relies on artificially created reservoirs in hot rock formations to exploit the earth's natural heat. A geothermal well system with an injector well and a producer well involves drilling into the Earth's subsurface to access hot rock formations. A working fluid is injected into the rock formation through the injector well, creating an artificial reservoir to heat the working fluid. The heated fluid is then extracted through the producer well (e.g., via an ESP assembly having an improved fluid intake section 116 of the type described herein) and used to generate electricity at the surface. The cooled fluid is re-injected into the injector well to maintain the heat exchange process.

In some embodiments, the ESP assembly 126 can be reconfigured for use at the surface. For example, the ESP assembly 126 can be reconfigured as a production pump assembly located at surface 102. For example, the ESP assembly 126 can be reconfigured as a horizontal surface pump assembly configured to pump fluid from the production tubing 108 or into the production tubing 108 via a wellhead 146. The horizontal surface pump assembly can be fluidically connected to the production tubing 108 via a wellhead 146, a production tree, or any suitable pressure isolation devices. The horizontal surface pump assembly can be located at surface 102 and configured to pump fluid, e.g., salt water, from a volume, e.g., pipeline or storage tank, into the production tubing 108 via the wellhead 146. In another scenario, the horizontal surface pump assembly can transfer, also referred to as boosting, wellbore fluid 112 from the production tubing 108 to another surface facility. The horizontal surface pump configuration (e.g., reconfiguration of the ESP assembly 126) may comprise at least one pump section 114, an intake section 116, a seal section 118 (also called a thrust chamber), and motor section 120. Although the horizontal surface pump configuration may have a different appearance than the downhole configuration of the ESP assembly 126, it is understood that the general description and function of the sections are the same. The horizontal surface pump reconfiguration of ESP assembly 126 may be mounted on a skid or installed within a surface facility.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An intake section of an electric submersible pump (ESP) assembly, comprising:

an intake housing generally cylindrical in shape and comprising an outer surface, an inner surface, an uphole end adjacent a pump section, and a downhole end adjacent a seal section;

an intake head generally cylindrical in shape and comprising an outer surface, an inner surface, and a first bushing surface coupled to the uphole end of the intake housing and a base of the pump section; and an intake base generally cylindrical in shape and comprising an outer surface, an inner surface, and a second bushing surface coupled to the downhole end of the intake housing and a header of the seal section, wherein the intake housing further comprises a proportional pattern of a plurality of inflow ports having one or more of the following features:

the proportional pattern comprising a density of inflow ports that increases as the pattern of ports moves axially away from the intake head; and the inflow ports comprising i) a hole cross-section, ii) an outer surface shape, iii) an inner surface shape, iv) a hole tilt angle, v) or combinations thereof, and wherein the hole tilt angle starts i) greater than or ii) about perpendicular to a central axis of the intake housing and decreases as the pattern moves axially away from the intake head toward the intake base.

2. The intake section of claim 1, wherein the hole cross-section includes i) a cylinder shape, ii) a transition to an inner surface shape, iii) a transition to an outer surface shape, or iv) combinations thereof.

3. The intake section of claim 2, wherein:

the inner surface shape is circular, ellipse, or frustoconical; and wherein i) a hole circumference on the inner surface of the intake housing is a) greater than or b) equal to a hole circumference on the outer surface.

4. The intake section of claim 2, wherein:

the outer surface shape is circular, ellipse, or frustoconical; and wherein i) a hole circumference on the outer surface a) greater than or b) equal to a hole circumference on the inner surface.

5. The intake section of claim 4, wherein:

the proportional pattern comprises a plurality of axial bands around a circumference of the intake housing defined by a perpendicular plane bisecting a central axis of the housing; wherein (i) a circumferential spacing of the holes in a given band is about equal;

(ii) the spacing of the bands decreases as the proportional pattern moves axially away from the intake head toward the intake base; or (iii) the number of bands in a uphole portion of an axial length of the housing is less than the number of bands in a corresponding downhole portion of the axial length.

6. The intake section of claim 1, wherein the inflow ports comprise hole shapes with inner shapes on the inner surface of the housing and outer shapes on the outer surface of the housing, the inner shapes are is different than the outer shapes, wherein: (i) the inner shapes are circular and the outer shapes are elliptical, (ii) the inner shapes are elliptical and the outer shapes are circular, (iii) the inner shapes are a mix of circular and elliptical and the outer shapes are circular (iv) the inner shapes are a mix of circular and elliptical and the outer shapes is are elliptical, (v) the inner shapes is are circular and the outer shapes are a mix of circular and elliptical, (vi) the inner shape is are elliptical and the outer shapes are a mix of circular and elliptical, or (vii) the inner shapes are a mix of circular and elliptical and the outer shapes are a mix of circular and elliptical.

7. The intake section of claim 6, wherein the inflow ports have hole draft that changes from the inner shapes to the outer shapes.

8. The intake section of claim 1, wherein:

the cross-section changes as the pattern moves axially away from the intake head toward the intake base.

9. The intake section of claim 1, wherein:

the intake base of the intake section further comprises one or more outflow ports configured to discharge flowback particles from an interior chamber of the intake section to an exterior of the intake section upon stopping operation of the pump.

10. The intake section of claim 1, wherein the ESP assembly comprises a pump section, the intake section, a seal section, a motor section, a sensor package, or any combination thereof.

11. The intake section of claim 10, wherein the intake section is fluidically coupled to the pump section.

12. The intake section of claim 11, wherein the intake section is configured to distribute an inflow of fluids across the outer surface of the intake housing in response to a positive suction head generated by the pump section.

13. The intake section of claim 12, wherein an electric motor within the motor section is coupled to a pumping mechanism within the pump section via a drive shaft extending from the electric motor to the pumping mechanism, wherein the electric motor drives the pumping mechanism, and wherein the pumping mechanism is configured to generate the positive suction head in response to being driven by the electric motor.

14. A method of distributing a flowrate of fluid across an outer surface of an intake section of an Electric Submersible Pump (ESP) assembly, comprising:

starting a pumping operation;

producing a positive suction head within a pump section in response to the pumping operation;

transferring a flowrate of fluids from an intake section into the pump section; and distributing the flowrate of fluids across an outer surface of an intake housing of the intake section in response to the positive suction head, wherein the intake housing comprises a proportional pattern of inflow ports, the inflow ports having hole shapes with inner shapes on the inner surface of the housing and outer shapes on the outer surface of the housing, the inner shapes are different than the outer shapes, wherein: (i) the inner shapes are circular and the outer shapes are elliptical, (ii) the inner shapes are elliptical and the outer shapes are circular, (iii) the inner shapes are a mix of circular and elliptical and the outer shapes are circular (iv) the inner shapes are a mix of circular and elliptical and the outer shapes are elliptical, (v) the inner shapes are circular and the outer shapes are a mix of circular and elliptical, (vi) the inner shape are elliptical and the outer shapes are a mix of circular and elliptical, or (vii) the inner shapes are a mix of circular and elliptical and the outer shapes are a mix of circular and elliptical.

15. The method of claim 14, wherein:

the flowrate of fluids are distributed across the outer surface by the proportional pattern of the inflow ports;

wherein the proportional pattern includes a density of inflow ports that increases as the pattern of ports moves axially away from the pump section; and wherein the inflow ports comprise i) a hole cross-section, ii) an outer surface shape, iii) an inner surface shape, iv) a hole tilt angle, v) or combinations thereof.

16. The method of claim 14, wherein:

the ESP assembly comprises a motor section, the intake section, and the pump section;

wherein the intake section is fluidically coupled to the pump section;

wherein a pumping mechanism within the pump section is rotationally coupled to an electric motor within the motor section via a drive shaft; and wherein the pumping mechanism is configured to generate a positive suction head in response to being driven by the electric motor.

17. The method of claim 14, further comprising:

transporting an ESP assembly to a remote wellsite;

coupling the ESP assembly to a production tubing;

electrically coupling an electric motor of the ESP assembly to a controller via a power cable;

conveying the ESP assembly, via the production tubing, into a wellbore penetrating a subterranean formation;

controlling the electric motor of the ESP assembly, via the controller, to perform a pumping operation; and pumping fluids, via the production tubing, i) from the formation to a surface location or ii) from the surface location to the formation.

18. The method of claim 17, wherein the wellbore is a producer wellbore of a Steam Assisted Gravity Drainage (SAGD) well system or a geothermal well system.

19. An electric submersible pump (ESP) assembly, comprising:

an electric motor coupled to a seal unit coupled to a fluid intake coupled to a pump, wherein the electric motor is configured to drive the pump via a drive shaft extending from the electric motor to the pump, wherein the fluid intake comprises:

a perforated housing having an inner surface, an outer surface, an uphole end adjacent the pump, and a downhole end adjacent the seal unit;

a head portion coupled to the uphole end of the perforated housing and a base of the pump; and a base portion coupled to the downhole end of the perforated housing and a head of the seal unit, wherein the perforated housing comprises a plurality of inflow holes, wherein a circumference of the plurality of inflow holes on the inner surface is greater than a circumference of the plurality of inflow holes on the outer surface, and wherein the plurality of inflow holes are arranged in a pattern having one or more of the following features:

(a) hole size on the outer surface of the housing increases as the hole pattern moves axially away from the head portion toward the base portion, wherein (i) hole size on the inner surface of the housing is constant or (ii) hole size on the inner surface of the housing changes as the hole pattern moves axially away from the head portion toward the base portion;

(b) hole shape on the inner and/or outer surface of the housing changes as the hole pattern moves axially away from the head portion toward the base portion;

(c) a hole shape on the inner surface of the housing that is different than a hole shape on the outer surface of the housing, including (i) inner shape is circular and outer shape is elliptical, (ii) inner shape is elliptical and outer shape is circular, (iii) inner shapes are a mix of circular and elliptical and outer shape is circular (iv) inner shapes are a mix of circular and elliptical and outer shape is elliptical, (v) inner shape is circular and outer shapes are a mix of circular and elliptical, (vi) inner shape is elliptical and outer shapes are a mix of circular and elliptical, or (vii) inner shapes are a mix of circular and elliptical and outer shapes are a mix of circular and elliptical;

(d) hole spacing decreases as the pattern moves axially away from the head portion toward the base portion;

(e) holes are arranged in a plurality of axial bands around a circumference of the housing defined by a perpendicular plane bisecting a central axis of the housing; wherein (i) circumferential spacing of the holes in a given band is about equal;

(ii) spacing of the bands decreases as the hole pattern moves axially away from the head portion toward the base portion; or (iii) a number of bands in a uphole portion of an axial length of the housing is less than a number of bands in a corresponding downhole portion of the axial length;

(f) hole tilt angle starts about perpendicular to the central axis of the housing and decreases as the pattern moves axially away from the head portion toward the base portion;

(g) hole tilt angle starts at greater than perpendicular to the central axis of the housing and decreases as the pattern moves axially away from the head portion toward the base portion;

(h) hole draft changes as the pattern moves axially away from the head portion toward the base portion;

(i) at least a portion of the plurality of inflow holes have a tapered or frustoconical cylinder cross-section, wherein frustoconical is defined as a hole having an outer circumference or diameter greater than an inner circumference or diameter;

(j) hole cross-section changes as the hole pattern moves axially away from the head portion toward the base portion;

(k) at least a portion of the plurality of inflow holes have an inverted tapered or inverted frustoconical cylinder cross-section, wherein inverted frustoconical is defined as a hole having inner circumference or diameter greater than an outer circumference or diameter; or (l) any combination of (a)-(k).

20. The ESP assembly of claim 19, wherein hole tilt angle starts i) greater than or ii) about perpendicular to the central axis of the housing and decreases as the pattern moves axially away from an intake head toward an intake base.

* * * * *